US006079614A

United States Patent [19]

Ho

[11] Patent Number: 6,079,614

[45] Date of Patent: Jun. 27, 2000

[54] FILE HOLDER

[76] Inventor: Cheng-Cheng Ho, No. 145, Han Chen St., Si Twen Dist., Taichung, Taiwan

[21] Appl. No.: 08/887,536

[22] Filed: Jul. 3, 1997

[51] Int. Cl.[7] ..... B65D 27/12; B42F 13/02

[52] U.S. Cl. ..... 229/67.1; 281/45; 402/60

[58] Field of Search ..... 229/67.1, 67.4, 229/71, 72; 281/21.1, 46, 47, 45, 49; 402/60

[56] References Cited

U.S. PATENT DOCUMENTS

| | | | |
|---|---|---|---|
| 3,870,223 | 3/1975 | Wyant | 229/72 |
| 4,301,962 | 11/1981 | Monckton et al. | 229/67.1 X |
| 4,636,179 | 1/1987 | Gentile et al. | 229/72 X |
| 4,991,767 | 2/1991 | Wyant | 229/67.1 |
| 5,226,676 | 7/1993 | Su | 229/67.1 X |
| 5,413,430 | 5/1995 | Schrem et al. | 402/60 |
| 5,472,238 | 12/1995 | Sato | 281/49 X |
| 5,884,836 | 3/1999 | Hatano et al. | 229/67.1 X |

*Primary Examiner*—Jes F. Pascua
*Attorney, Agent, or Firm*—W. Wayne Liauh

[57] ABSTRACT

A file folder includes a first panel, a second panel connected with the first panel along a fold line, a flap cut out from the first panel, and a C-shaped clamp defining a clamping mouth thereon. Each of the first and second panels defines an internal surface opposed to each other. The flap is formed from the material of the first panel and is secured to the second panel along a hinge line coincident to the fold line. The flap is pivotal about the hinge line and can be folded to partially cover the internal surface of the second panel. One end of the clamp is pivotally connected with the second panel near one end of the hinge line. The clamping mouth of the clamp faces the hinge line of the flap such that the clamp can be pivoted between a first position clamping the flap together with the second panel and a second position releasing the flap and the second panel. Loose papers can be placed on the internal surface of the second panel having one edge of the papers partially received between the flap and the second panel. The clamp can then be swung to clamp the papers together with the flap and second panel such that the loose papers can be held and secured within the folder without the need to punch holes on the papers.

8 Claims, 8 Drawing Sheets

FILE HOLDER

BACKGROUND OF THE INVENTION

1. Field of the Invention

This invention relates to a file folder and, more particularly, to a file folder which has a clamp pivotally connected thereon to secure loose papers within the folder without requiring punched holes on the papers.

2. Background of the Invention

File folders are commonly used for holding loose papers since they provide a convenient and efficient way to organize and secure loose papers. FIG. 1 illustrates one kind of conventional file folders. The file folder 1 shown in FIG. 1 generally comprises two panels 11,12 formed by folding a soft sheet-like material along a central hinge line so as to receive papers between the inner surfaces of the panels 11,12. Each inner surfaces of the panels 11,12 is attached with a film-like material forming a packet 13,14 respectively to place loose papers therein. In order to avoid breakage or tear from the end points of the connected edges 15,16 of the pockets 13,14, stress release grooves 131,141 are formed near the end points of the edges 15,16 to increase the strength of the structure. However, such kind of prior art folder 1 has a significant deficiency since the loose papers held within the folder 1 can not be secured. Various loose papers may occasionally be admixed when they are frequently put into or taken out of the folder 1. Furthermore, the papers held within the folder 1 may also possibly be dropped out or even lost during transportation.

FIG. 2 represents another kind of conventional file folder 2 which is made of a relatively hard sheet-like material and, as the same as the previously described folder 1, also comprises two panels 21,22 connected along a central hinge line. One panel 21 is furnished with a pocket 23 by attaching a flexible sheet-like material thereon, wherein two stress release grooves 231 are formed near two ends of the connected edges of the pocket 23. On the panel 22 near the central part of the hinge line is furnished with a conventional two-hole type fastener 24 which typically comprises two prong-like springs for securing loose papers having coordinated holes. However, since paper punchers may not always be available and users may not always be willing to punch holes on their papers or files, thereby, the scope of using such a prior art folder 2 is still limited and further improvements of the file folders are thus needed.

SUMMARY OF THE INVENTION

In view of the aforesaid limitations of conventional file folders, it is therefore an object of the present invention to provide a file folder which can hold loose papers securely without having to punch holes on the papers. The file folder has generally a very simple structure and thus can be manufactured with relatively low cost.

It is another object of the present invention to provide a file folder for holding loose papers. The file folder comprises: a first panel, a second panel connected with the first panel along a fold line, a flap cut out from the first panel at a position near a central part of the fold line, and a C-shaped clamp defining a clamping mouth thereon. Each of the first and second panels defines an internal surface opposed to each other for placing papers therebetween. The flap is formed from the material of the first panel and is secured to the second panel along a hinge line coincident to the fold line. The flap is pivotal about the hinge line and can be folded toward a position partially covering the internal surface of the second panel. One end of the clamp is pivotally connected with the second panel at a location near one end of the hinge line of the flap. The clamping mouth of the clamp faces the hinge line of the flap such that the clamp can be pivoted between a first position clamping the flap together with the second panel and a second position releasing the flap and tie second panel. Therefore loose papers can firstly be placed on the internal surface of the second panel having one edge of the papers partially received between the flap and the second panel, then the clamp can be swung to clamp the flap and the second panel together with the papers such that loose papers can be held and secured within the folder without the need to punch holes on the papers.

It is yet a further object of the present invention to provide a file folder for holding loose papers. The file folder comprises two panels connected with each other along a central fold line. A rectangular window is formed on one of the panels and is covered by a rectangular transparent film having a size larger than the window such that the window can be over-covered by the transparent film. Three edges of the rectangular transparent film are respectively adhered to three coordinated edges of the window and leaves one other edge free without being adhered so as to substantially form a transparent pocket upon the window. Users can look through the window and the transparent pocket of the folder to identify the existence of the papers as well as read the words printed on the papers if they exist. A card-like object having a size larger than the window but smaller than the pocket can also be insert into the transparent pocket. The card-like object can be printed with words indicating a title or subject of the papers held within the folder.

It is still another object of the present invention to provide a file folder for holding loose papers. The file folder comprises two panels connected with each other along a central fold line. A pocket is formed from material of the panels and is furnished on a lower part of one of the panels. The left and bottom edges of the pocket are secured to the coordinated edges of the panel while leaving the up and right sides of the pocket free for receiving papers.

Two straight through slits are formed on the pocket and are extended along a direction perpendicular to the bottom edge of the panel. The two slits are parallel to each other and are spaced apart a distance which is slightly narrower than the width of a normal personal business card. Each of the slits defines an upper end and a lower end thereof and has two stress release holes respectively located at the upper and lower ends. The two upper holes of the two straight slits are spaced from each other with a distance wider than which of the two slits. In addition, the distance between the other two holes located at the lower ends of the slits is narrower than which between the two slits. Therefore a normal personal business card can be insert between the two straight through slits having the left and right sides of the card secured by the slits while leaving the words printed on the card remained visible.

BRIEF DESCRIPTION OF THE DRAWINGS

The foregoing features of the present invention may be more fully understood from the following detailed description, read in conjunction with the accompanying drawings, wherein.

DESCRIPTION OF THE PREFERRED EMBODIMENT

Figure 1:
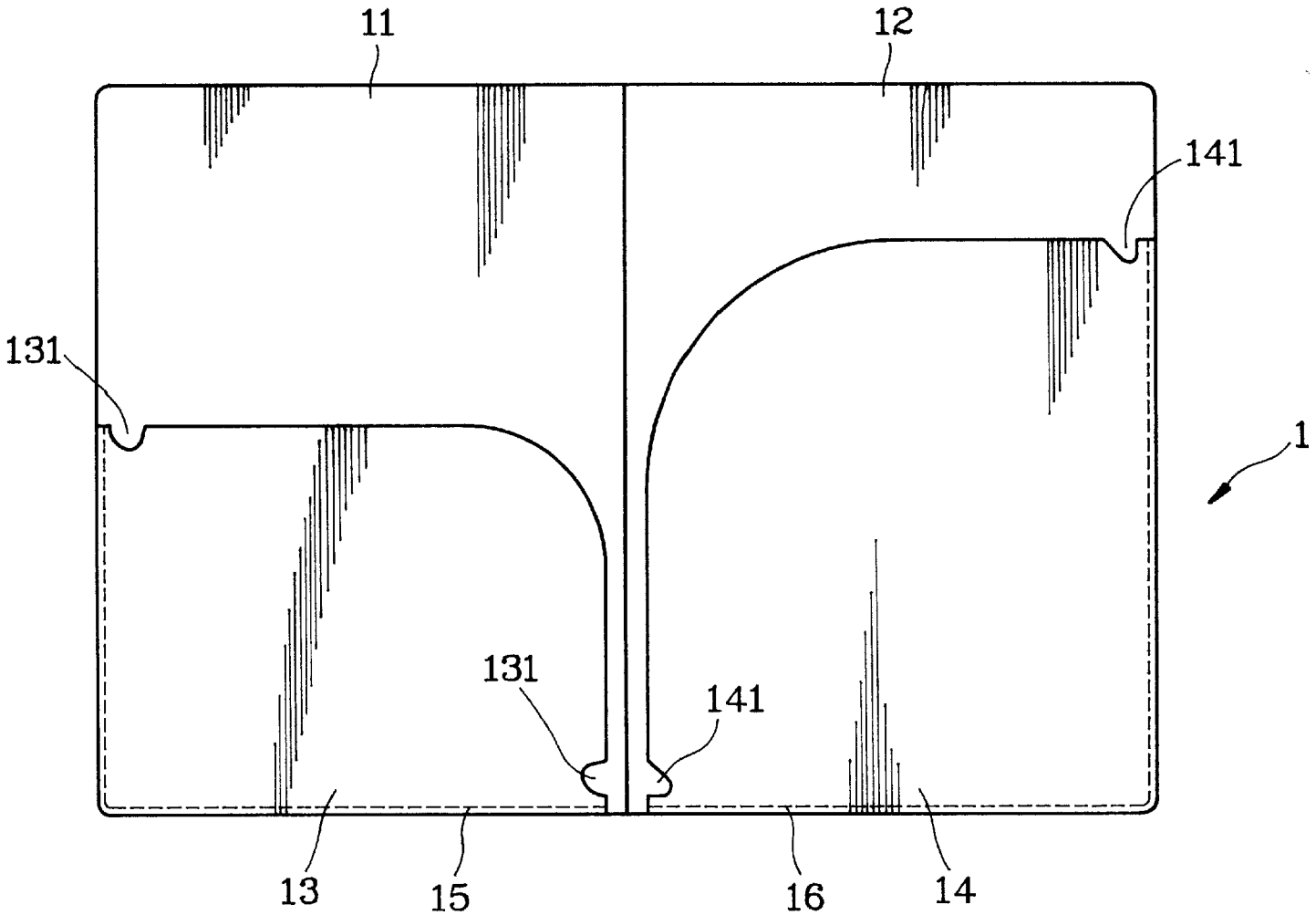
FIG. 1 (prior art)
FIG. 1 is a top view of a conventional file folder.
Figure 2:
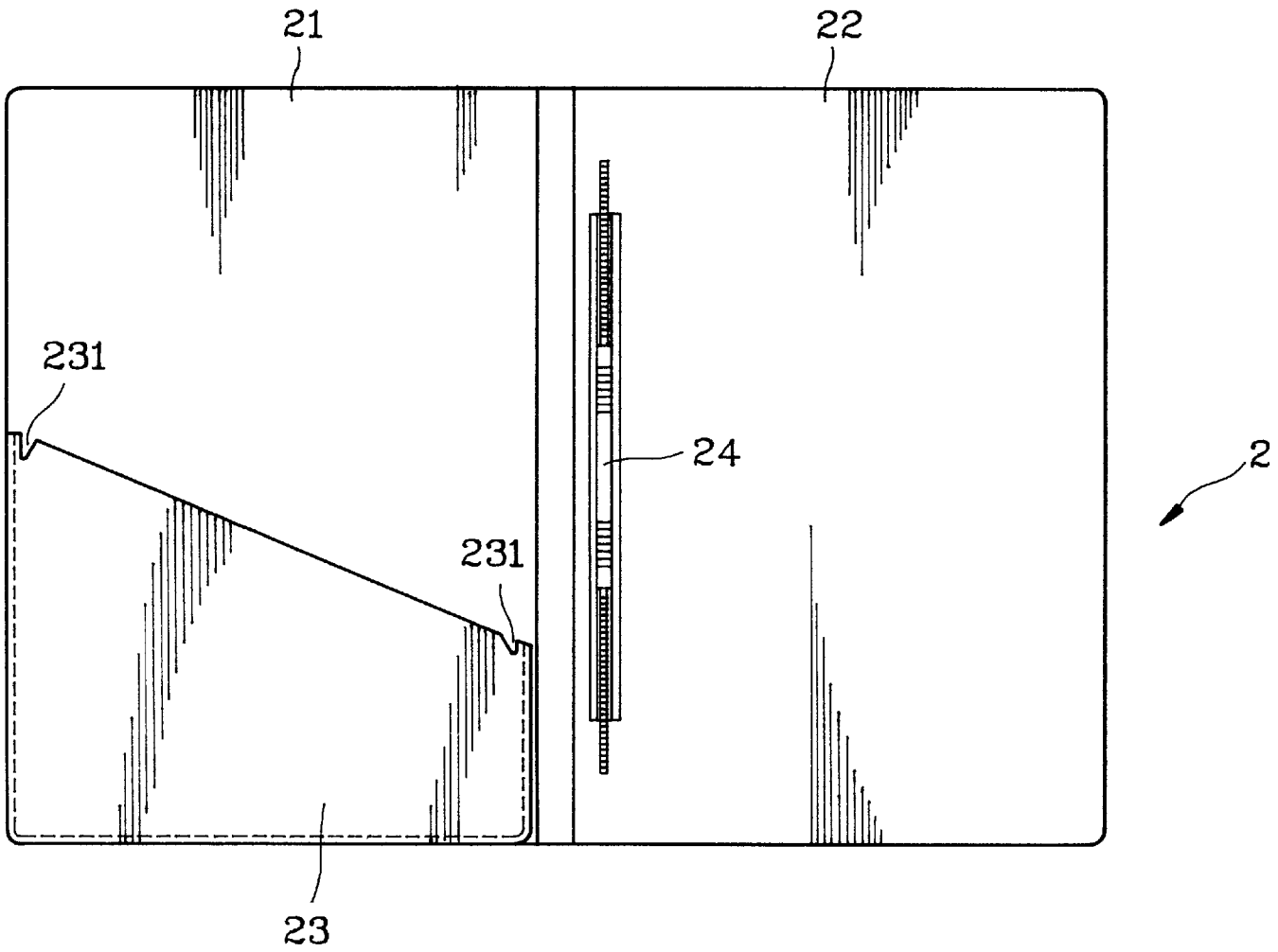
FIG. 2 (prior art)
FIG. 2 is a top view of another conventional file folder furnished with a fastener.
Figure 3:
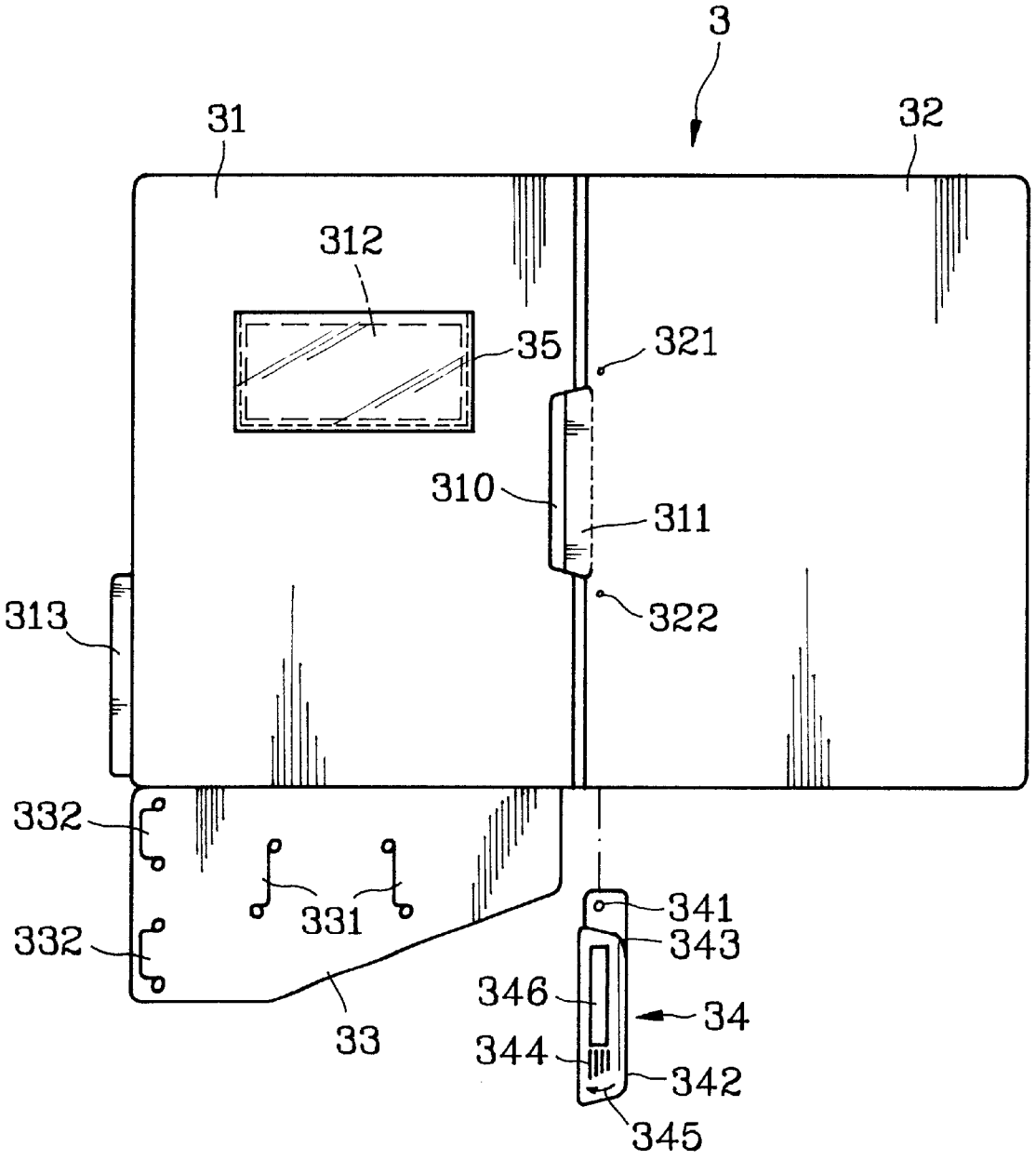
FIG. 3 is an exploded view of a preferred embodiment of a file folder in accordance with the present invention (with the pocket 33 unfolded).

Referring to FIG. 3, which schematically illustrates a preferred embodiment of a file folder 3 in accordance with the present invention wherein primary elements of the file folder 3 are disassembled. The file folder 3 is typically made of a hard sheet-like plastic material. By the manufacturing processes of die-pressing, folding and cutting, the file folder 3 is formed with a first panel 31, a second panel 32 connected with the first panel 31 along a central fold line, and a pocket 33 connected with a bottom edge of the first panel 31. Loose papers (not shown in this figure) can be placed between two opposed internal surfaces of the first and second panels 31,32 when the file folder 3 is folded. An elongated through opening 310 and an elongated flap 311 are cut out from the first panel 31 and are located near a middle part of the fold line. The flap 311 is formed from the material of the first panel 31 and is elongated so as to define two opposed long sides and two opposed short sides thereof. The elongated flap 311 has one of its long sides secured to the second panel 32 along a hinge line which, in this embodiment, coincides with the fold line. The flap 311 is pivotal about the hinge line thereof and can be folded toward a direction partially covering a left side of the internal surface of the second panel 32.

Figure 5:
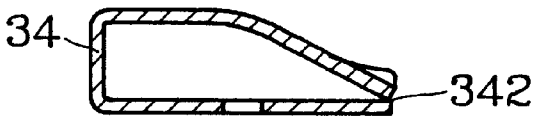
FIG. 5 is a left side view of the C-shaped clamp shown in FIG. 4.

The first panel 31 is formed with a rectangular window 312. A rectangular transparent film having a size lager than the window 312 is adhered to the internal surface of the first panel 31 and is covering the window 312 by means of having only three edges of the film adhered to three coordinated edges of the window 312 and leaving one other edge free so as to form a transparent pocket 35 upon the window 312. A lower part of the left edge of the first panel 31 is formed with an elongated connecting portion 313 which can be folded up along the left edge of the first panel 31 to face the internal surface of the first panel 31 such that the pocket 33 can be folded up along the bottom edge of the first panel 31 having its left edge adhered to the connecting portion 313 so as to make the left and bottom edges of the pocket 33 secured to the first panel 31 while leaving the up and right sides of the pocket 33 free as shown in FIG. 5. Two C-shaped through slits 332 are formed near the left side of the pocket 35, wherein each of the slits 332 is formed with two stress release holes at two ends thereof. Two straight through slits 331 are formed at middle of the pocket 35 and are extended along a direction perpendicular to the bottom edge of the pocket 35. The two slits 331 are parallel to each other and are spaced apart an appropriate distance which is slightly narrower than the width of a normal personal business card. Each of the straight slits 331 has two stress release holes formed at two ends thereof. The two upper holes of the two straight slits 331 are apart from each other with a distance wider than which of the two slits 331 while the distance between the two lower holes are relatively shorter than which of the two slits 331, such that the slits 331 substantially define a receiver to receive a card-like object such as a normal business card. Of course, it is noted that the distance between the two upper holes of the slits 331 is also sufficient to receive the card-like object. In addition, two through holes 321,322 are formed on the second panel 32 and are respectively located near two ends of the hinge line of the flap 311.

Figure 4:
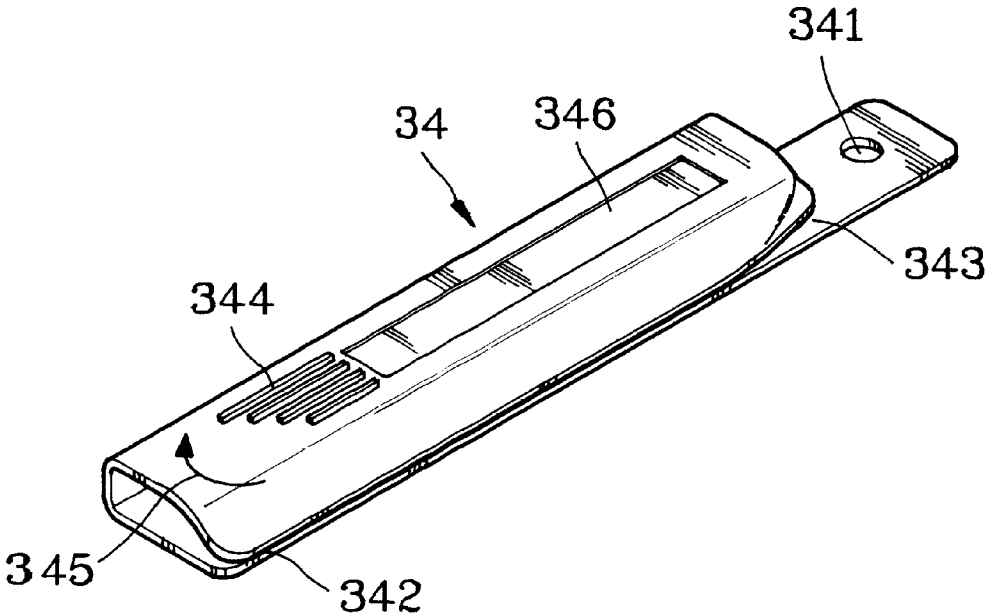
FIG. 4 is a perspective view of a C-shaped clamp in accordance with the file folder shown in FIG. 3.

Referring to FIG. 4 and FIG. 5, an elongated C-shaped clamp 34 having a size generally similar to the flap 311 is made of a plastic material and defines a clamping mouth 342 and a receiving opening 343 thereon. One end of the clamp 34 is formed with an extended flat portion having a through hole 341 thereon. The hole 341 of the clamp 34 is pivotally connected at the hole 321 of the second panel 32. The clamping mouth 342 of the clamp 34 faces the hinge line of the flap 311 such that the clamp 34 can be swung about the hole 321 between a first position receiving the flap 311 together with the left edge of the second panel 32 and a second position releasing the flap 311 and the second panel 32. The receiving opening 343 of the clamp 34 is located at one end near the hole 341 and has a relatively wider mouth compared to the rest part of the clamp 34 such that the flap 311 together with the second panel 32 can be easily and readily received from the go receiving opening 343. A plurality of raised stripes 344 are formed on the clamp 34 to increase friction such that the clamp 34 can be easily held and swung. An arrow symbol 345 is furnished on an upper surface of the clamp 34 at one end opposite to the end having the hole 341 and indicates a direction following which the clamp 34 can be swung to clamp the flap 311 and the second panel 32. A flat recess 346 is also formed on the upper surface of the clamp 34 such that the user can stick a label (not shown in figures) onto the flat recess 346 to make the folder 3 easy to be organized and managed.

Figure 6:
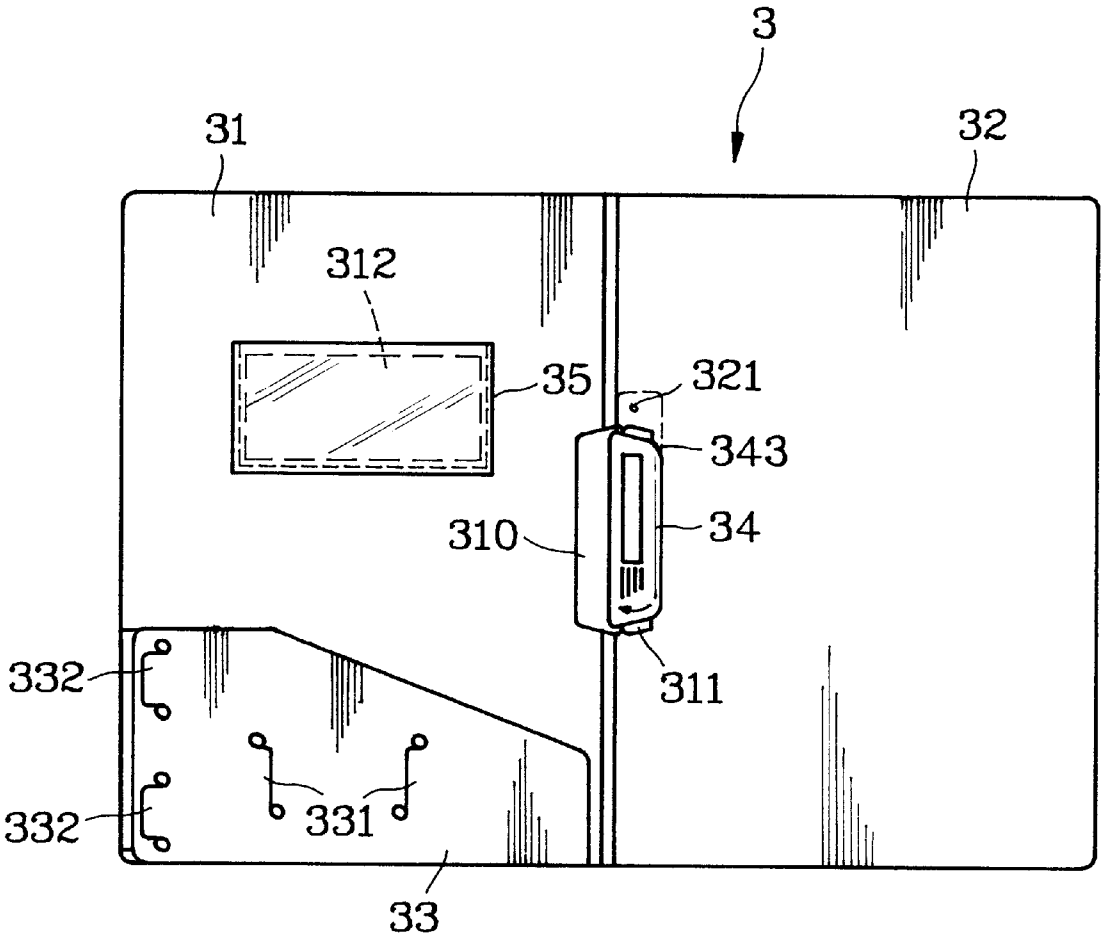
FIG. 6 is a top view of the file folder shown in FIG. 3 with all elements well assembled.
Figure 7:
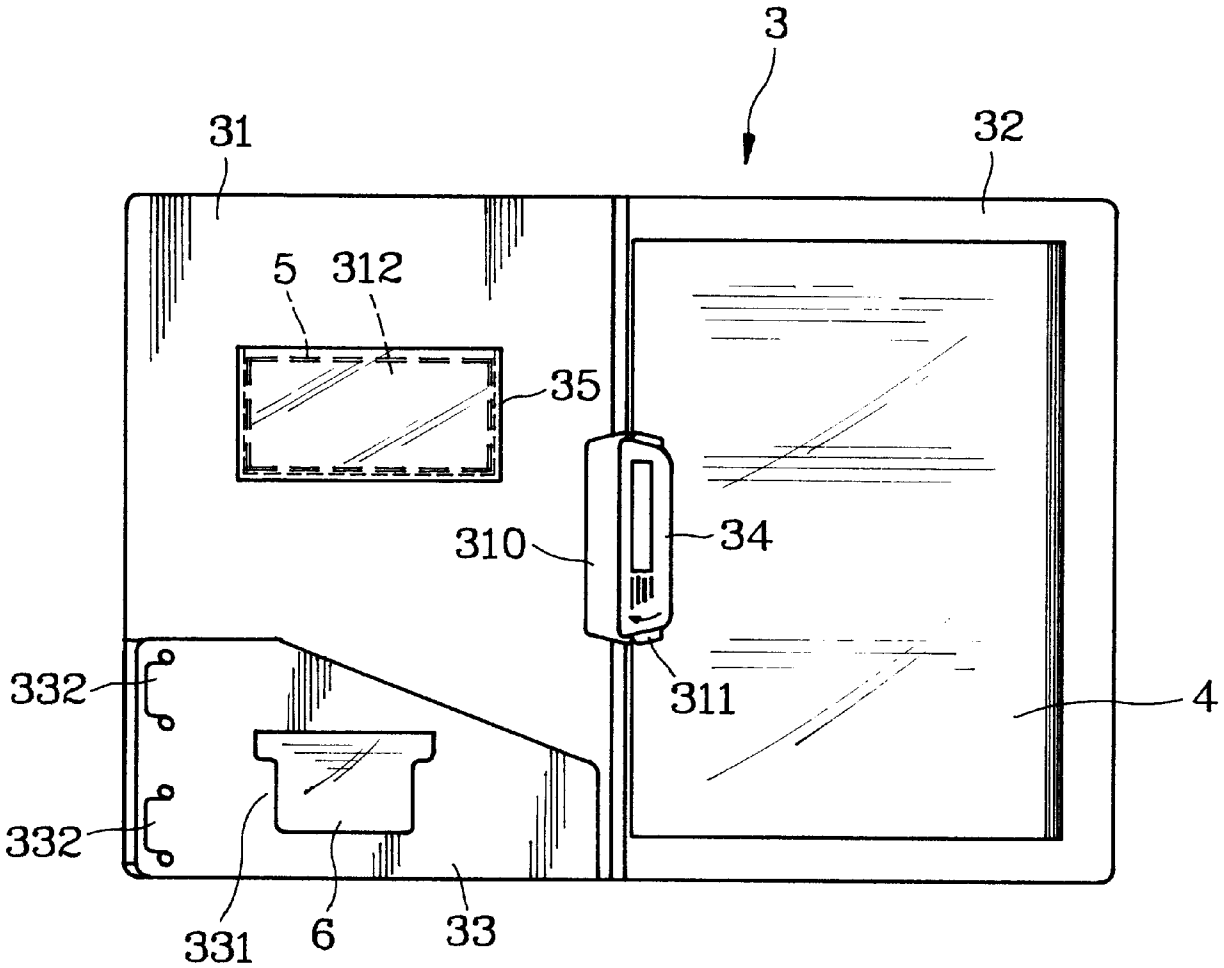
FIG. 7 is a schematic view of the file folder shown in FIG. 3 in use state.

Referring to FIG. 6 and FIG. 7, which respectively represent the above illustrated embodiment of the present when well assembled and in use state. When the pocket 33 is loaded with papers, the C-shaped through slits 332 can make the pocket 33 more elastic and capable to contain thicker papers without the danger of breakage or tear from the edges of the pocket 33. To use the folder 3 to hold papers 4, as shown in FIG. 7, the papers 4 are firstly placed on the internal surface of the second panel 32 having the left edge of the papers 4 received between the flap 311 and the second panel 32. Then the user swings the clamp 34 about the hole 321 in a counterclockwise direction to clamp the flap 311, the second panel 32 and the left edge of the papers 4 within the clamp 34 securely. The receiving opening 343 can make the clamp 34 easier to receive the papers 4 even when the papers 4 are relatively thick. Since one edge of the papers 4 is clamped and secured by the clamp 34, the papers 4 can be leafed over without the possibility of being drop out or admixed. Furthermore, there is no need to punch holes on the papers 4 at all.

When the first panel 31 is folded to cover the papers 4 and the second panel 32, the user can look through the window 312 and the transparent pocket 35 of the first panel 31 to identify the existence of the papers 4 as well as read the words printed on the front page of the papers 4. A card-like object 5 having a size larger than the window 312 but smaller than the transparent pocket 35 can also be inserted into the transparent pocket 35. The card-like object 5 can be printed with words indicating the title or subject of the papers 4 held within the folder 3. A normal personal business card 6 can be inserted between the two straight through slits 331 having the left and right sides of the business card 6 secured by the straight through slits 331 while leaving the words printed on the business card 6 remained visible. Since the two upper holes formed at the upper ends of the straight slits 331 are distanced wider than the width of the business card 6 and the lower two holes formed at the lower ends of the straight slits 331 are distanced narrower than the width of the card 6, therefore the card 6 can be held securely between the straight slits 331. When there is a need to release the papers 4 from the clamp 34, the user can use his/her fingers to pinch the raised stripes 344 of the clamp 34 and swung the clamp 34 following the direction indicated by the arrow symbol 345 such that the papers 4 clamped by the clamp 34 can be released and taken out from the folder 3. It can be easily understood from the above description that the file folder 3 has generally a very simple structure and thus can be easily manipulated and manufactured with relatively low cost.

It is noted that following illustrated embodiments have in general similar structure like the one shown in FIG. 6. Therefore same numerals are used for similar type of elements.

Figure 8:
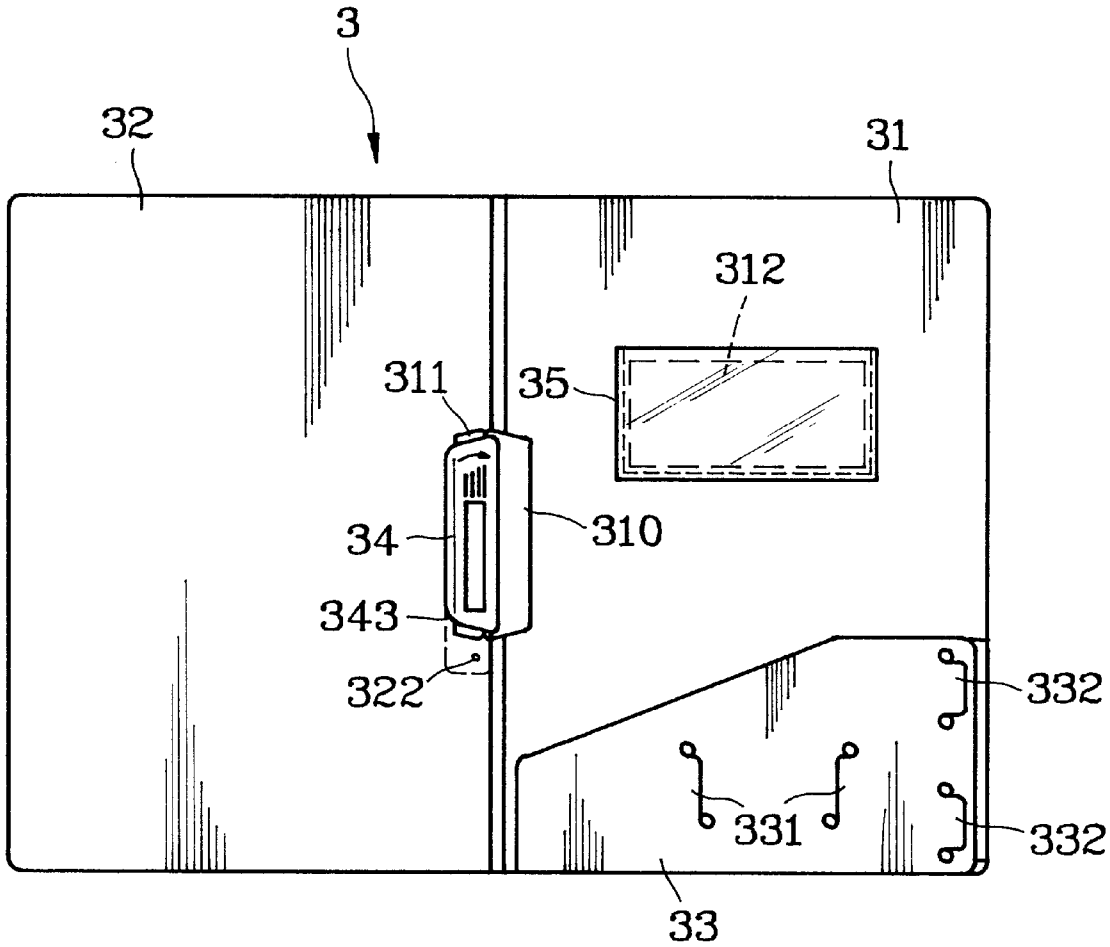
FIG. 8 is a schematic view of another preferred embodiment of the present invention (with the clamp pivotal about the hole 322).

FIG. 8 illustrates another embodiment in accordance with the present invention wherein the clamp 34 is pivotal about the hole 322 of the second panel 32 such that the clamp 34 can be swung counterclockwise to clamp the flap 311 and clockwise to release the flap 311.

Figure 9:
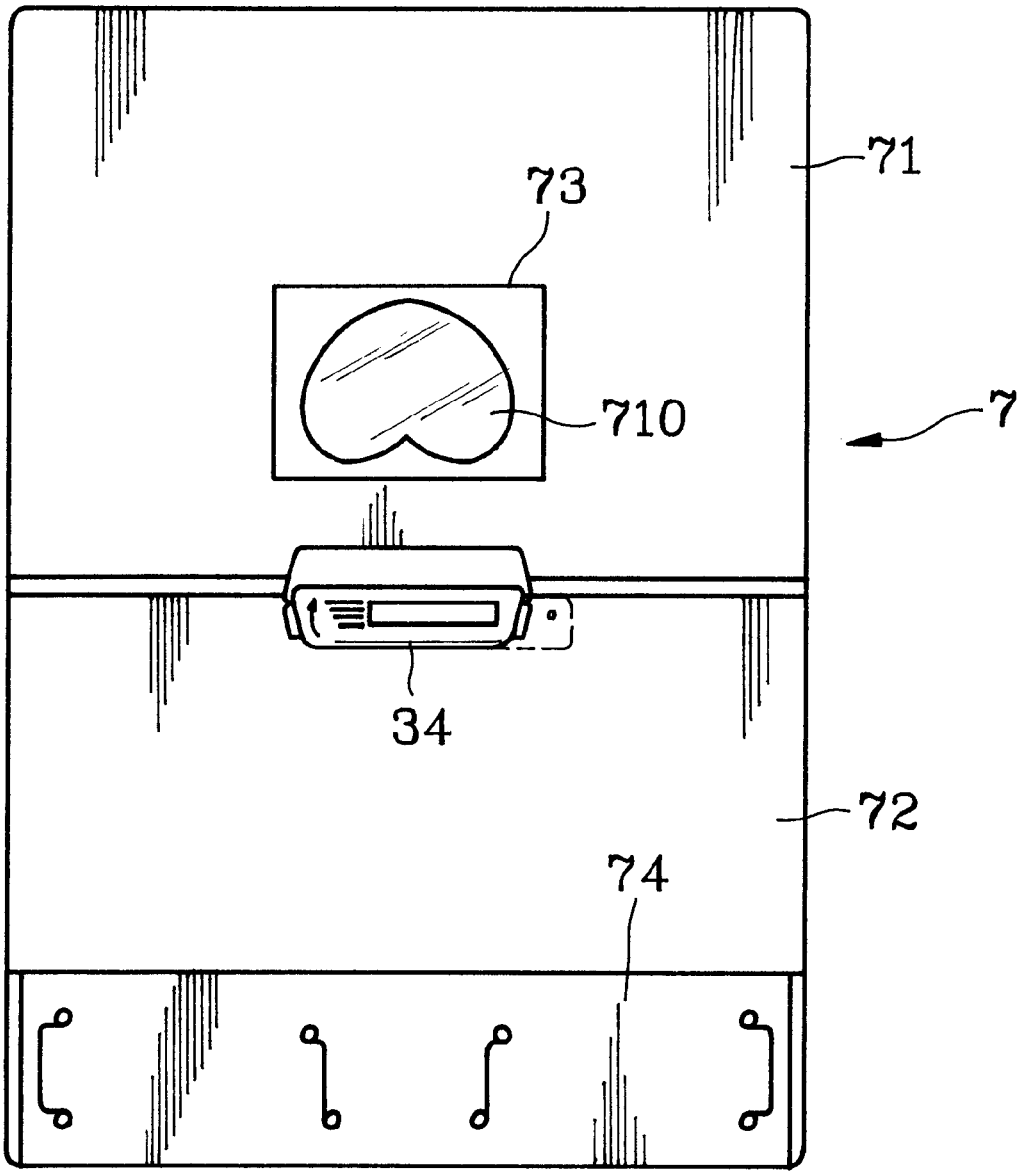
FIG. 9 is a schematic view of yet another preferred embodiment of the present invention (with the pocket furnished on the second panel of the folder).

FIG. 9 illustrates yet another embodiment of the file folder 7 wherein the central fold line between the first and second panels 71,72 is horizontal. The window 710 formed on the first panel 71 is not rectangular but is in rather an interesting design such like a heart shape shown in FIG. 9. A rectangular transparent film having a size sufficient to cover the heart-shaped window 710 is adhered to the window 710 to form a transparent pocket 73 by adhering only three edges of the film but leaving one other edge free. A pocket 74 is furnished on the lower part of the second panel 72 for receiving papers.

Although certain specific embodiment of the present invention has been shown and described above, it is to be understood that many modification thereof are possible. The present invention, therefore, is not to be restricted except insofar as is necessitated by the prior art and by the spirit of the appended claims.

I claim:

1. A file folder for holding loose sheet like objects comprising:

a first panel and a second panel connected with said first panel along a fold line, said first and second panels each defining an internal surface opposed to each other for placing at least one loose sheet like object therebetween;

a flap cut out from said first panel at a position near a central part of said fold line, said flap being secured to the second panel along a hinge line parallel to said fold line and being foldable about said hinge line toward a position partially covering the internal surface of the second panel; and a C-shaped clamp defining a clamping mouth thereon, one end of said clamp being pivotally connected with said second panel at a location near one end of said hinge line of the flap, said clamping mouth facing said hinge line of said flap such that said clamp can be pivoted between a first position clamping said flap together with the second panel and a second position releasing the flap and the second panel;

wherein said clamp is furnished with a plurality of raised stripes for increased friction, an arrow symbol indicating a direction following which the clamp can be swung to said second position to release said flap and said second panel, and a flat recess located at a upper surface of the clamp for sticking a label.

2. A file folder of claim 1 wherein said file folder is made of a sheet-like plastic material and said first and second panels are formed by folding said sheet-like plastic material along said fold line.

3. A file folder of claim 1 wherein said first panel further has a window formed thereon, said window on said first panel being covered by a transparent film having a size larger than said window for over-covering said window.

4. A file folder of claim 1 wherein a pocket is formed on a lower part of said first panel having left and bottom edges of said pocket secured to said first panel while leaving top and right sides of said pocket free for receiving papers.

5. A file folder of claim 4 wherein two C-shaped through slits are formed near the left edge of the pocket such that when the pocket is loaded with papers, said C-shaped through slits make the pocket more elastic so as to prevent breakage from the edges of the pocket.

6. A file folder of claim 5 wherein each of said C-shaped slits is formed with two stress release holes at two ends thereof.

7. A file folder for holding loose sheet like objects comprising:

a first panel and a second panel connected with said first panel along a fold line, said first and second panels each defining an internal surface opposed to each other for placing at least one loose sheet like object therebetween;

a flap cut out from said first panel at a position near a central part of said fold line, said flap being secured to the second panel along a hinge line parallel to said fold line and being foldable about said hinge line toward a position partially covering the internal surface of the second panel; and a C-shaped clamp defining a clamping mouth thereon, one end of said clamp being pivotally connected with said second panel at a location near one end of said hinge line of the flap, said clamping mouth facing said hinge line of said flap such that said clamp can be pivoted between a first position clamping said flap together with the second panel and a second position releasing the flap and the second panel;

wherein said first panel further has a window formed thereon, said window on said first panel being covered by a transparent film having a size larger than said window for over-covering said window;

further wherein said window and said transparent film are of rectangular shape defining four edges thereof, said transparent film having its three edges adhered respectively to three coordinated edges of said window and leaving one other edge free without being adhered so as to substantially form a transparent pocket upon the window.

8. A file folder for holding loose sheet like objects comprising:

a first panel and a second panel connected with said first panel along a fold line, said first and second panels each defining an internal surface opposed to each other for placing at least one loose sheet like object therebetween;

a flap cut out from said first panel at a position near a central part of said fold line, said flap being secured to the second panel along a hinge line parallel to said fold line and being foldable about said hinge line toward a position partially covering the internal surface of the second panel; and a C-shaped clamp defining a clamping mouth thereon, one end of said clamp being pivotally connected with said second panel at a location near one end of said hinge line of the flap, said clamping mouth facing said hinge line of said flap such that said clamp can be pivoted between a first position clamping said flap together with the second panel and a second position releasing the flap and the second panel;

wherein a pocket is formed a lower part of said first panel having left and bottom edges of said pocket secured to said first panel while leaving top and right sides of said pocket free for receiving papers;

further wherein two straight through slits are formed on said pocket and are extended along a direction perpendicular to the bottom edge of the pocket, said two straight through slits being parallel to each other and being spaced apart an appropriate length slightly narrower than which of a normal personal business card, each of the straight through slits defining an upper end and a lower end thereof and having two stress release holes respectively located at said upper and lower ends, the two holes located at said upper ends of said two straight through slits being spaced from each other with a distance wider than which of said two slits while the distance between the other two holes located at the lower ends of said straight through slits being relatively shorter than which of said two slits.

* * * * *